US008845326B2

(12) United States Patent
Shaffer et al.

(10) Patent No.: US 8,845,326 B2
(45) Date of Patent: Sep. 30, 2014

(54) GAS BURNER ASSEMBLY

(75) Inventors: Timothy Scott Shaffer, Louisville, KY (US); Eric K. Watson, Crestwood, KY (US); Brian Michael Schork, Louisville, KY (US); Paul Bryan Cadima, Prospect, KY (US); Paul E. McCrorey, Mount Washington, KY (US)

(73) Assignee: General Electric Company, Schenectady, NY (US)

( * ) Notice: Subject to any disclaimer, the term of this patent is extended or adjusted under 35 U.S.C. 154(b) by 849 days.

(21) Appl. No.: 12/903,420

(22) Filed: Oct. 13, 2010

(65) Prior Publication Data

US 2012/0090595 A1 Apr. 19, 2012

(51) Int. Cl.
*F24C 3/08* (2006.01)

(52) U.S. Cl.
USPC ..... 431/284; 431/198; 431/286; 431/200; 431/354; 431/349; 431/278; 431/18; 239/558; 239/562; 239/568; 239/549; 126/39 E; 126/39 R

(58) Field of Classification Search
USPC ..... 126/39 E, 1 R, 39 R; 431/278, 280, 284, 431/349, 354, 350
See application file for complete search history.

(56) References Cited

U.S. PATENT DOCUMENTS

| | | | | |
|---|---|---|---|---|
| 2,870,828 | A | 9/1953 | Hess | |
| 2,891,608 | A * | 6/1959 | Mueller | 431/194 |
| 3,796,535 | A * | 3/1974 | De Gouville | 431/349 |
| 4,083,355 | A * | 4/1978 | Schwank | 126/39 J |
| 4,891,006 | A * | 1/1990 | Le Monnier de Gouville et al. | 431/349 |
| 5,277,576 | A * | 1/1994 | Hartung et al. | 431/198 |
| 5,526,838 | A * | 6/1996 | Robert | 137/12 |
| 5,899,681 | A * | 5/1999 | Maughan | 431/8 |
| 6,135,764 | A * | 10/2000 | Kwiatek | 431/266 |
| 6,244,263 | B1 * | 6/2001 | Schlosser et al. | 126/39 R |
| 6,263,868 | B1 * | 7/2001 | Koch et al. | 126/39 R |
| 6,325,619 | B2 * | 12/2001 | Dane | 431/284 |
| 6,607,378 | B2 * | 8/2003 | Harneit et al. | 431/354 |
| 6,712,605 | B2 * | 3/2004 | Moresco | 431/354 |
| 6,764,303 | B2 * | 7/2004 | Dane et al. | 431/354 |
| 6,830,061 | B2 * | 12/2004 | Adams et al. | 137/12 |
| 7,291,009 | B2 | 11/2007 | Kamal et al. | |
| 2005/0221243 | A1 | 10/2005 | Najewicz et al. | |
| 2011/0120445 | A1 * | 5/2011 | Armanni | 126/39 E |

* cited by examiner

*Primary Examiner* — Kenneth Rinehart
*Assistant Examiner* — Sharla Magana
(74) *Attorney, Agent, or Firm* — Global Patent Operation; Douglas D. Zhang

(57) ABSTRACT

An gas burner assembly for a cooking appliance includes a main burner assembly, a simmer burner assembly positioned in a stacked relationship with and located below the main burner assembly, a venturi assembly for delivering a gas flow to the main burner assembly, a gas boost pump configured to control a pressurization of the gas flow, a gas valve assembly for controlling a rate of the gas flow, and an encoder coupled to the gas valve assembly, the encoder configured to track a position of the gas valve assembly and provide a signal to the gas boost pump for pressurization of the gas flow.

19 Claims, 18 Drawing Sheets

| Type | Run | D1 inch | D2 inch | Rate (D2/D1) | %PA | Pressure 1 inch H2O | Pressure 2 inch H2O | Pressure 3 inch H2O |
|---|---|---|---|---|---|---|---|---|
| Original | 1 | 1.5 | 0.375 | 25% | 63 | -0.702 | 0.001 | 0.001 |
| Original | 2 | 1.5 | 0.750 | 50% | 136 | -0.237 | 0.006 | 0.004 |
| Original | 3 | 1.5 | 1.125 | 75% | 164 | -0.080 | 0.009 | 0.007 |
| Flare Inlet | 1 | 1.5 | 0.500 | 33% | 101 | -0.560 | 0.003 | 0.002 |
| Flare Inlet | 2 | 1.5 | 0.750 | 50% | 143 | -0.227 | 0.007 | 0.005 |

GAS BURNER ASSEMBLY

BACKGROUND

The present disclosure generally relates to a gas range system, and more particularly to enhancement of burner performance of a gas range system for a cooking appliance.

Conventional gas operated cooking appliances such as gas cooktops, for example, have one or more burners in which gas is mixed with air and burned. The burner will typically include an orifice and venturi assembly for the entrainment of air and for mixing the air with the gas required to generate the burner power output. The process of drawing air into the gas stream upstream of the burner assembly is referred to as "primary entrainment." The gas is fed to the burner via a gas feed supply line that is connected to a suitable gas source. The flow of gas is mixed with the air in the venturi assembly to provide the primary aeration of the burner.

Generally, the gas coming out of the gas orifice has enough velocity and energy that when directed into the underside inlet of the gas burner it will induce surrounding air under the burner to be entrained with the gas stream into the burner. This is called "primary air" since it is prior to the combustion point or flame of the burner. For complete combustion of the gas (natural gas), approximately 9.4 parts of air is needed for every part of gas. If there is 100% primary air, all of the required 9.4 parts of air to go with the gas are present. (A 25000 Btu/hr burner with 100% primary air would have 0.416 cubic feet/min of gas and 3.91 cubic feet/min of primary air). If there is 143% primary air, there is 13.44 parts of air for every part of gas. At some point, if there is too much air, the mixture will be too lean and unable to start a flame.

In cases where a burner does not have 100% primary air, air comes in from outside the flame to supply the necessary air to complete the combustion. All residential burners are well below 100% primary air. The flames spread outward when a pot is placed over the flame because the flame has to work harder to find the secondary air it needs to completely combust the gas. With 100% primary air, the flames do not reach out around the pot because the flame already has all the air it needs.

The burner can also include burner ports that stabilize the flames for heating and cooking Additional air is entrained into the fuel downstream of the burner ports in what is referred to as "secondary entrainment." The combination of the primary and secondary entrainment of air into the gas provides the reactants required for complete combustion of the gas delivered to the burner ports. Because such secondary entrainment occurs downstream of the burner ports, in a region in which cooking and handling activities take place, it is often desirable to limit the reliance on secondary entrainment. For higher capacity burners, it is desirable to boost the primary entrainment. One example of a system for boosting primary entrainment in a gas cooktop is described in U.S. patent application Ser. No. 10/814,722, filed on Mar. 31, 2004 and assigned to the assignee of the instant application, the disclosure of which is incorporated herein by reference in its entirety.

For gas burners, a turndown ratio is the ratio of the maximum output to the minimum output of the burner. Generally, the maximum output corresponds to the "power" or "speed" of the burner, while the minimum output corresponds to "simmer" capability of the burner. Because of the wide volumetric range associated with a high output burner, a larger turndown ratio, or a turbo burner, is most desirable for customers. A maximum output for such a high output burner will typically correspond to approximately 25,000 BTU/Hr, while a typical simmer rating is approximately 1,000 BTU/Hr. This results in a 25:1 turndown ratio, which is much higher than a typical BTU range, generally having turndown ratios of approximately 10:1. This wide range from the maximum output to the minimum output must also have a smooth transition.

To accomplish the range for a 25:1 turndown ratio, a stacked burner can be used. A stacked burner, also referred to as a vertically staged burner, generally uses two rings of gas outlets or ports, one over the other. One stage is used for simmer, while a combination of both stages can be used for power cooking One example of a dual stacked gas burner is described in U.S. Pat. No. 7,291,009, assigned to the assignee of the instant invention, the disclosure of which is incorporated herein by reference in its entirety. However, this stacked arrangement can create problems with controlling the gas flow to the appropriate burner and transitioning between burners while maintaining a prescribed, smooth output for the entire burner output range.

Generally in a stacked burner system, the simmer burner chamber can receive primary air from the primary air chamber of the main burner. Due to the relatively large diameter of the inlet into the main burner, the inlet into the simmer ring will dramatically skew the flow/flame distribution pattern around the simmer flame ports. It would be advantageous to be able to limit the skew of the flow/flame distribution pattern around the simmer flame ports.

A gas fuel boost pump may also be used to enhance a gas burner system in order to achieve a higher 25:1 turndown ratio. Traditional gas burners have very thin, uniform cross-section transition zones between the pre-combustion chamber and the flame port exit. In a gas fuel boost pump enhanced system, the high flow rates distributed through the main burner can create high turbulent intensity in these transition zones, where the mixture of primary air and the gas is not uniformly distributed. When combustion occurs in these zones, the white noise generated in these pockets can be significantly loud and may pose a perception problem with the consumer in the relatively quiet kitchen environment. It would be advantageous to be able to reduce the noise generated in these high turbulent intensity zones near the flame ports.

Where a gas fuel boost pump is used to increase the pressure of the gas flow received from the gas flow line, the gas flow must directly correlate with the gas valve stem and gas knob rotational position. This requires the ability to modulate the power to the gas fuel boost pump based on the knob position.

Traditional gas burners have burner ports that are generally configured to deliver a flame flow that is parallel to the cooking surface and the cooking utensil above the burner. This condition directly affects the efficiency of the burner to deliver heat to the cooking utensils. Gas burners are typically only 30-40% efficient. It would be advantageous to be able to increase the efficiency of a gas burner to deliver heat to the cooking utensil on the burner.

In a gas burner that provides an output of approximately 17,000-18,000 BTU/hr, the gas flow rate entering the venturi of the burner is in the range of approximately 2 to 2.5 cubic feet per minute (cfm). In order to increase the burner output, the input flow rate must also be increased. One way to do this while maintaining or increasing primary air entrainment is to increase the flow cross-sections. However, the amount of space that is available under the cooktop is limited. It would be advantageous to be able to increase the flow rate through the venturi despite the limited area under the cooktop. In addition, large flow cross-sections can be susceptible to the flame flashing back into the burner under low combustion simmer rates unless the primary air entering the burner is not sustainably increased to maintain port velocities above flame velocities associated with methane, natural gas, butane, and propane. It would be advantageous to balance a large flow area through the burner while maintaining a stable flame that does not flash back into the burner under low flow conditions.

Accordingly, it would be desirable to provide a system that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a gas burner assembly for a cooking appliance. In one embodiment, the cooking appliance includes a main burner assembly, a simmer burner assembly positioned in a stacked relationship with and located below the main burner assembly, a venturi assembly for delivering a gas flow to the main burner assembly, a gas boost pump configured to control a pressurization of the gas flow, a gas valve assembly for controlling a rate of the gas flow, and an encoder coupled to the gas valve assembly, the encoder configured to track a position of the gas valve assembly and provide a signal to the gas boost pump for pressurization of the gas flow.

Another aspect of the disclosed embodiments relates to a burner assembly for a gas cooking appliance. In one embodiment, the burner assembly comprises a main burner assembly. The main burner assembly includes a pre-combustion chamber, a main flame exit port, and a transition region between the pre-combustion chamber and the main flame exit port. Each end of the transition region is tapered. The burner assembly also includes a simmer burner assembly positioned in a stacked relationship with and located below the main burner assembly. The simmer burner assembly includes a simmer burner combustion chamber, and a simmer flame exit port. A flow dam ring is positioned within the simmer burner combustion chamber. The flow dam ring includes one or more ports along an upper edge of the flow dam ring, the ports configured to redistribute gas flow within the simmer burner combustion chamber.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
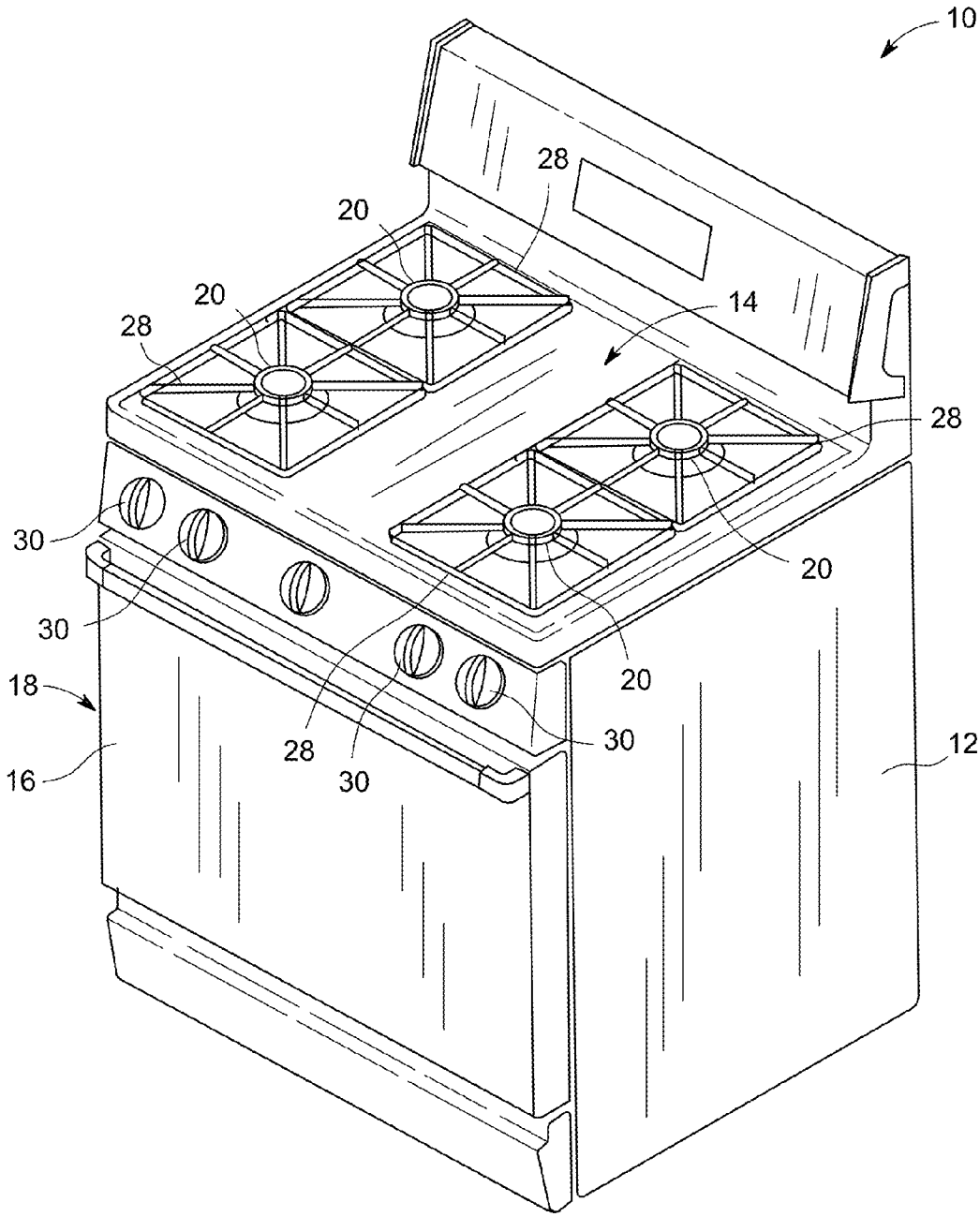
FIG. 1 is a perspective view of an appliance incorporating aspects of the disclosed embodiments.

Referring to FIG. 1, an exemplary cooking appliance, such as a free-standing gas range, incorporating aspects of the disclosed embodiments, is generally designated by reference numeral 10. The aspects of the disclosed embodiments are directed to improving the efficiency of a gas burner system. Although the aspects of the disclosed embodiments will generally be described herein with respect to a burner assembly for a gas cooktop, the aspects of the disclosed embodiments can also be applied to other gas fired devices, such as for example, gas heater devices, gas ovens, gas barbeques and other such applications where a venturi is used in conjunction with a gas burner.

The range 10 shown in FIG. 1 generally includes an outer body or cabinet 12 that incorporates a substantially rectangular cooktop 14. In one embodiment, an oven 18 can be positioned below the cooktop 14 which can include a front-opening access door 16.

The cooktop 14 shown in FIG. 1 includes four gas fueled burner assemblies 20 that are positioned in a spaced apart relationship. In alternate embodiments, the cooktop 14 can include any number of gas fueled burner assemblies 20 arranged in any suitable configuration. Each burner assembly 20 generally extends upwardly through an opening in the cooktop 14, and a grate 28 can be positioned over each burner assembly 20. Each grate 28 can include horizontally extending support structures thereon for supporting cooking vessels. Although the gas burner assemblies 20 are shown in FIG. 1 as being substantially similar, in alternate embodiments, the gas burner assemblies 20 can be of different sizes to accommodate different sized cooking vessels.

Figure 2:
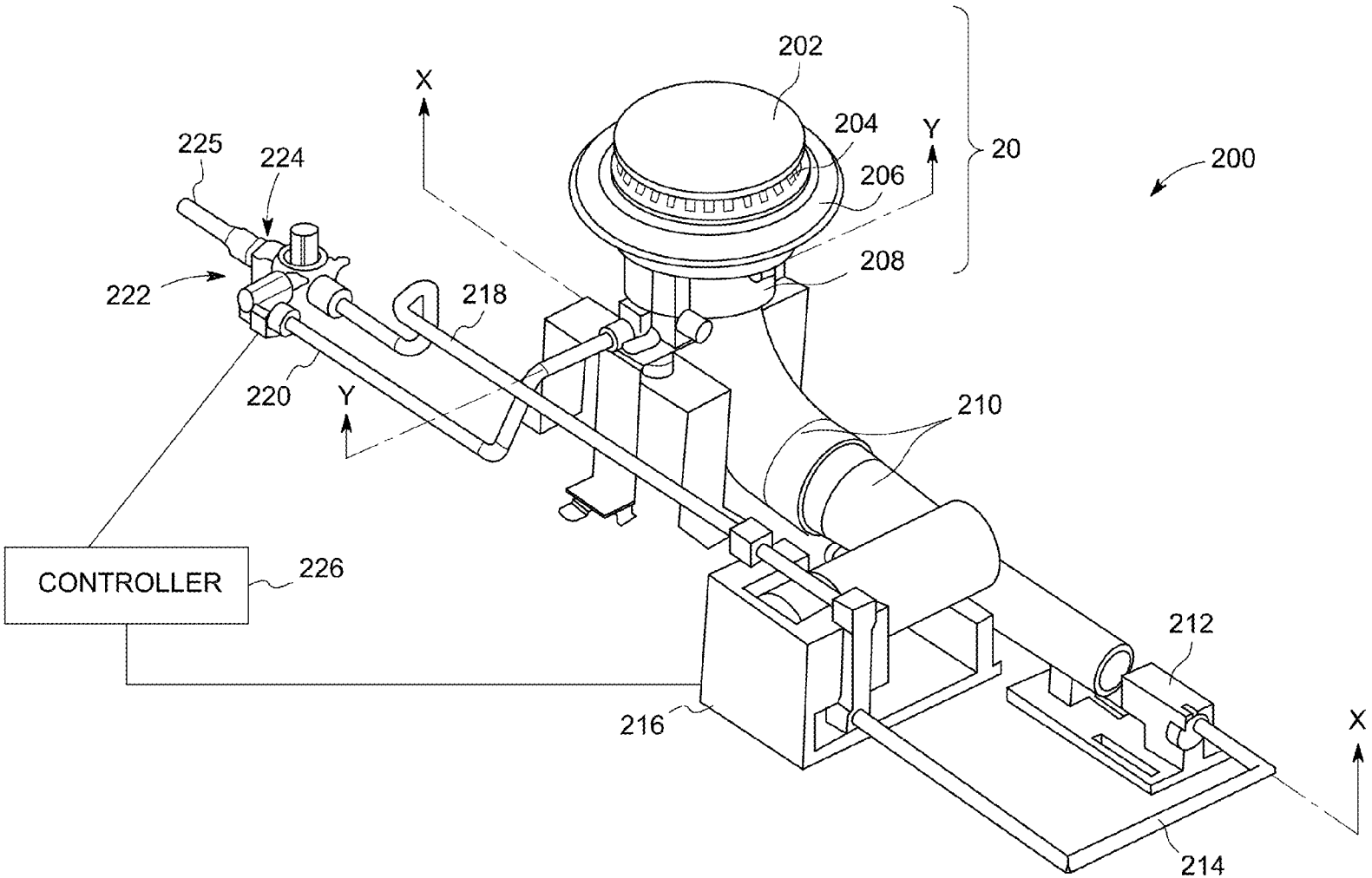
FIG. 2 is a perspective view of one embodiment of a turbo gas system for the appliance of FIG. 1.

The cooktop 14 can also include one or more control devices, such as knobs 30 that are manipulated by the user to adjust the setting of a corresponding gas valve, such as gas valve 224 shown in FIG. 2, to control the amount of heat output from the corresponding burner assembly 20. For example, referring to FIG. 3, in one embodiment, rotating knob 30 in direction A switches the valve from the Off position 308 towards the maximum (Max) burner output setting or position 304. Continued rotation of the knob 30 in the direction A gradually moves the valve 224 from the maximum setting (Max) 304 to the minimum setting (Simmer) 306. In this manner, the user can adjust the heat output of the corresponding burner to the desired level. Although the control devices are generally described herein as knobs, in alternate embodiments, the control device can comprise any suitable control mechanism, such as for example, a slidable switch or electronic control.

FIG. 2 illustrates one example of a gas turbo system 200 for a range 10 incorporating aspects of the disclosed embodiments. As is shown in FIG. 2, a gas burner assembly 20 is coupled to a venturi assembly 210. In one embodiment, the gas burner assembly 20 generally comprises a cap 202, a main or power burner 204, a simmer burner or ring 206 and a venturi transition assembly 208. In one embodiment, the venturi transition assembly 208 couples the venturi assembly 210 to the burner assembly 20. An injet assembly 212 is coupled to the gas pump 216 by exhaust tubing 214. Inlet tubing 218 couples the gas pump 216 to the dual adjustable gas valve assembly 224. Simmer burner tubing 220 couples the gas valve assembly 224 to the simmer burner 206. The gas valve assembly 224 is coupled to an encoder 222 for regulating the gas flow depending upon a position of the gas valve assembly 224. In one embodiment, the control knobs 30 shown in FIG. 1 will generally couple to a stem 225 of the gas valve assembly 224 and are used to set the desired gas flow.

The gas valve assembly 224 generally controls the rate of gas flow between the gas manifold or pump 216 and each individual gas burner assembly 20. In one embodiment, a rotational encoder 222 is coupled to the valve stem 225 and gas valve assembly 224 and is configured to monitor the rotational angle of the knob 30. The encoder 222 is configured to communicate the rotational angle or position of the knob 30 via an electrical signal to a controller 226 or other suitable control device that controls the gas pump 216 to deliver the gas flow level corresponding to the position of the knob 30, when needed. In most common uses where the gas flow through the gas pump 216 and simmer tubing 220 is close to approximately 10,000 Btu/hr(the maximum unassisted gas flow), the gas pump 216 will not be required. However, in those cases where a feature or knob position is selected where the maximum available flow or a gas flow over 10,000 Btu/hr is required, the gas flow must be supplemented via the gas pump 216.

When the gas pump 216 is activated, the gas flow is manipulated by electronically controlling the speed of the gas pump 216 so that a near linear slope is achieved between the maximum available flow of approximately 25,000 Btu/hr and a point close to the maximum unassisted flow rate of approximately 10,000 Btu/hr. In one embodiment, this activation state or mode of the gas pump 216 is referred to herein as a high output or "turbo" mode or condition.

Figure 3:
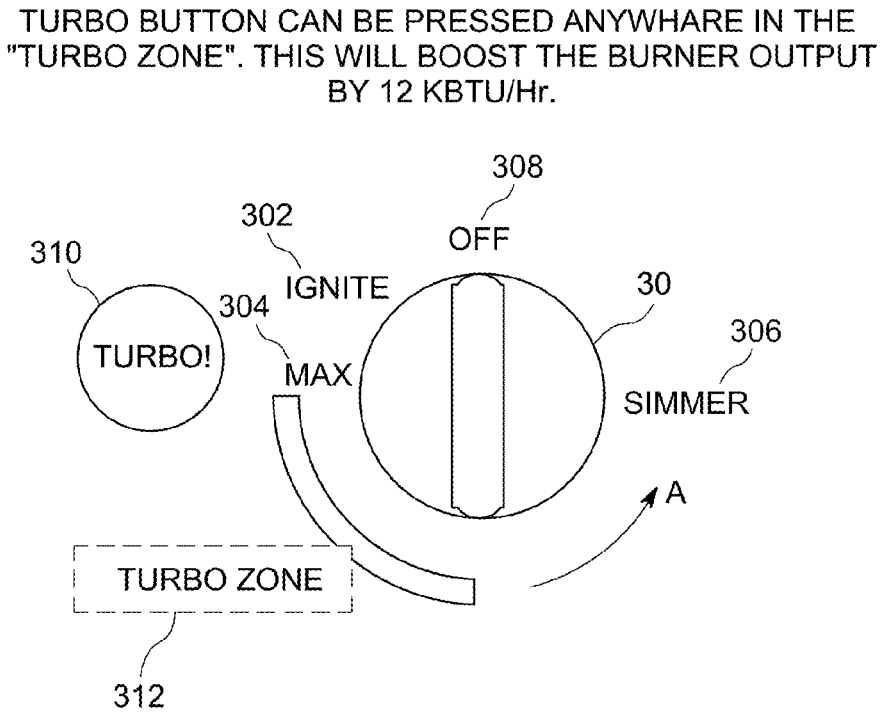
FIG. 3 illustrates a schematic view of one embodiment of a control system for a turbo gas system of the present disclosure.

In one embodiment, referring to FIG. 3, the range 10 can include a burner high output control or switch 310, referred to herein as a "turbo" button, that is manipulated by the user to select and activate the turbo mode. Although a button 310 is shown in FIG. 3 and generally described herein, in alternate embodiments, any suitable control device can be used to activate the gas pump 216 to increase the gas flow up to the maximum available flow rate.

As is shown in FIG. 3, the control knob 30 can be rotated through a range of positions, described herein as Ignite 302, maximum (Max) 304, Simmer 306 and Off 308. A turbo zone 312 is also included. The turbo zone 312 generally corresponds to a position of the gas knob 30 where the gas flow must be supplemented via the gas pump 216 in order to provide the desired heat or burner output. In accordance with the aspects of the embodiments disclosed herein, the turbo mode is energized or enabled when the gas knob 30 is at a position corresponding to the range designated as the turbo zone 312. If the turbo button 310 is activated while the position of the gas knob 30 is within the turbo zone 312, the turbo mode is activated. When the turbo mode is activated, the gas pump 216 is energized and the gas flow is electronically controlled by the speed of the gas pump 216. Activation of the turbo mode will increase or boost the burner output by approximately 12 KBTU/hr.

Figure 4:
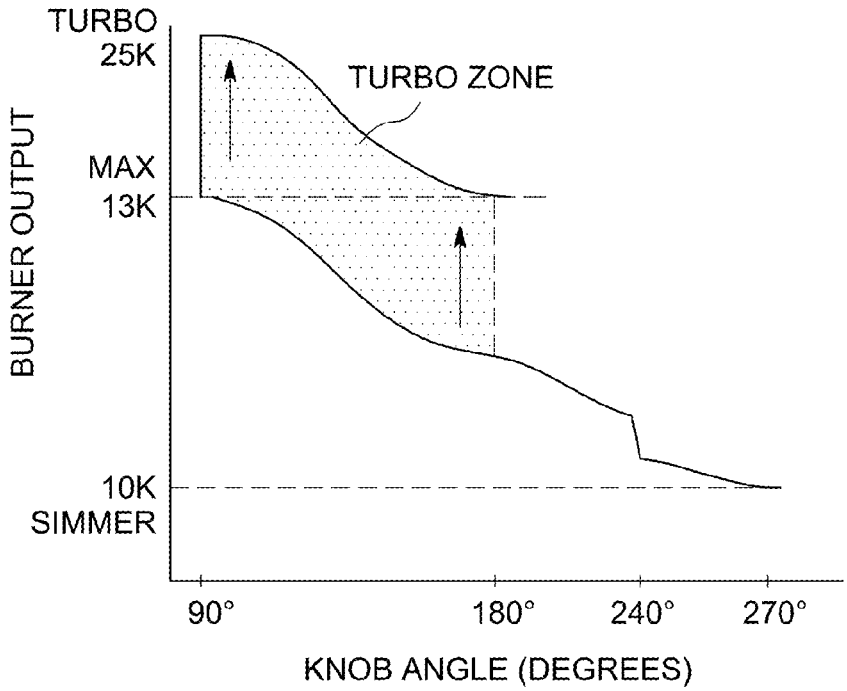
FIG. 4 is a graph illustrating control knob angle against burner output according to an embodiment of the present disclosure.

Referring to FIG. 4, a graph is shown that plots the angle of rotation of the knob 30 against the burner output. In the zone of knob travel between 90 and 180 degrees of rotation, or as the knob is turned in direction A from the maximum position 304 towards the simmer position 306 in the turbo zone 312, the gas flow is gradually restricted and power of the burner is gradually decreased. When the turbo mode is engaged, the gas flow is increased essentially uniformly along this same degree of rotation by approximately 12K Btu/hr. Although the gradual e restriction is still present along this path, the booster pump induces higher overall gas flows through the valve by sucking more gas into its inlet downstream of the valve. After rotation of almost 90 degrees, or once the knob 30 is past the turbo zone 312, the gas pump 216 will automatically shut down and the valve assembly 224 shown in FIG. 2 will mechanically restrict gas flow from approximately 10,000 Btu/hr to approximately 4,000 Btu/hr, through another 45 degrees of rotation of knob 30. After this point, up until and including the simmer position 306, the main flow path is completely shut off, and only the simmer flow of approximately 2,000 Btu/hr is continued. The remaining travel of the gas valve assembly 224 is used to mechanically throttle back on the simmer flow rate from approximately 2,000 Btu/hr to approximately 800 Btu/hr.

Figure 5:
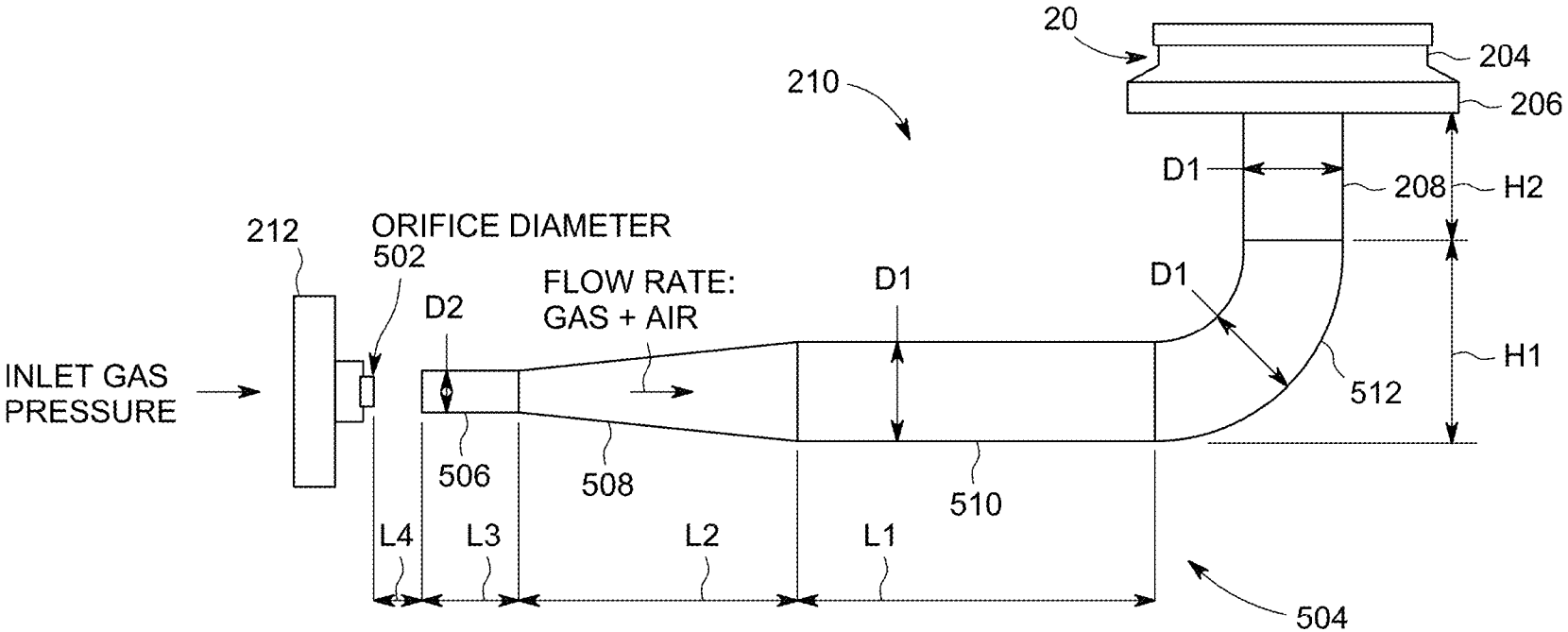
FIG. 5 is a side view of a venturi and gas burner assembly according to an embodiment of the present disclosure.
Figure 6:
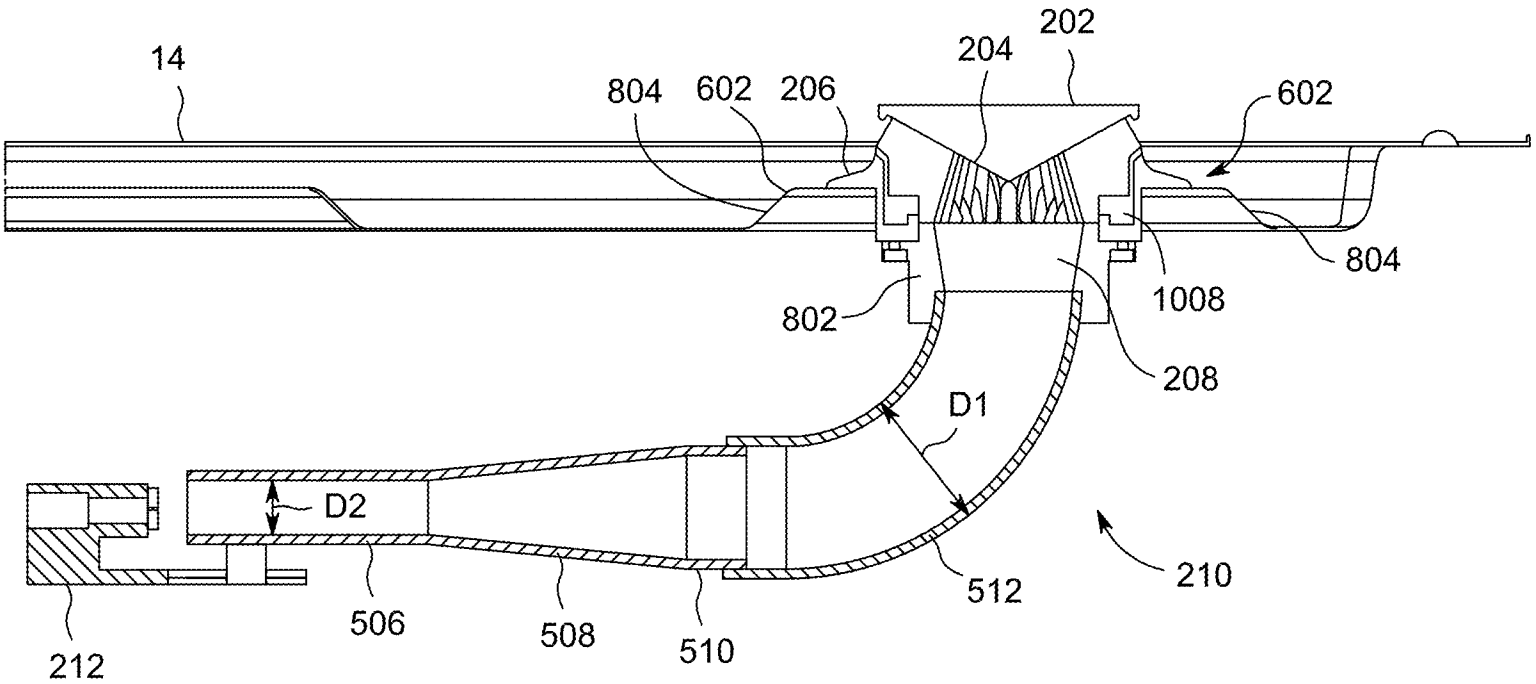
FIG. 6 is a partial cross-section view of a venturi and gas burner assembly taken along the line X-X of FIG. 2, according to an embodiment of the present disclosure.

As shown in FIG. 2, the turbo system 200 includes a venturi assembly 210. FIGS. 5 and 6 illustrate one embodiment of an exemplary venturi assembly 210 incorporating aspects of the disclosed embodiments. As is shown in FIG. 5, gas enters the orifice 502 from the injet assembly 212. The combination of gas and air then travels through the venturi tubing assembly 504 to the burner assembly 20. A distance L4 between the orifice 502 and the venturi tubing assembly can be approximately 0.5 inches. The venturi tubing assembly 504 is generally made up of one or more tubing sections 506-512. In this example, section 506 is the inlet section and has a length L3 of approximately 0.75 inches. Transition section 508 has a length L2 of approximately 2.5 inches. The straight section 510 can have a length L1 in the range of approximately 0.5 to 2.5 inches. Section 512, also referred to herein as the venturi elbow transition or tubular elbow includes an approximately 90 degrees transition or bend. The venturi elbow transition 512 is generally configured to facilitate the path of the gas into the main burner 204. In one embodiment, the height H1 of the venturi elbow transition is in the range of approximately 2 to 4 inches, and preferably approximately 3 inches. The height H2 of the vertical straight tube or venturi transition member 208 can be in the range of approximately 0.5 to 1.5 inches, and preferably approximately 1 inch. Although the venturi tubing assembly 504 is shown in FIG. 5 as a number of connected tubing sections, in one embodiment, the venturi tubing assembly 504 can comprise a single section, or one or more sections.

The gas orifice 502 shown in FIG. 5 feeds a high velocity gas stream into the entrance or inlet section 506. The gas stream into the inlet section 506 creates a local vacuum that pulls local air into the venturi assembly 210 along with the gas. In one embodiment, a desired ratio of air-to-natural gas is approximately 9.4, which is the ratio generally required for complete combustion of the gas. At flow rates of approximately 25,000 Btu/hr and a standard inlet gas pressure of approximately 5-inches water column, the actual air-to-gas ratio can be much lower than the desired ratio, and in some cases less than 20% of the desired ratio. When pressurized to levels in the region of approximately 70 to 90 inches of water column, the air-to-gas ratio can be much greater than 9.4. If the air-to-gas ratio gets too high, such as greater than approximately 13.4, the gas-air mixture can become too lean to maintain a flame.

In a standard burner, the flow rates entering the venturi assembly 210 to support a burner output from approximately 17,000-18,000 BTU/hr generally range from approximately 2 to 2.5 cubic feet per minute (cfm). In a burner of the disclosed embodiments, where a burner output of approximately 25,000 BTU/hr is supported, the flow rate must be able to accommodate at least 6 cfm. This requires that the cross-sections of the tubing assembly 504 be larger to accommodate the increased flow rate. In one embodiment, a flow cross-section of the elbow transition 512, having the approximately 90-degree bend, is increased by a factor of at least two relative to the cross-section of the diameter D2 of the inlet section 506. Test data has indicated that increasing the diameter D1 through the 90-degree bend elbow transition 512 is twice as effective as a normally smaller cross-section venturi. The additional diameter D1 of the venturi elbow transition 512 also improves the air-gas homogeneity, which reduces sound emissions at the combustion point due to a reduced flame lift up.

Figure 7:
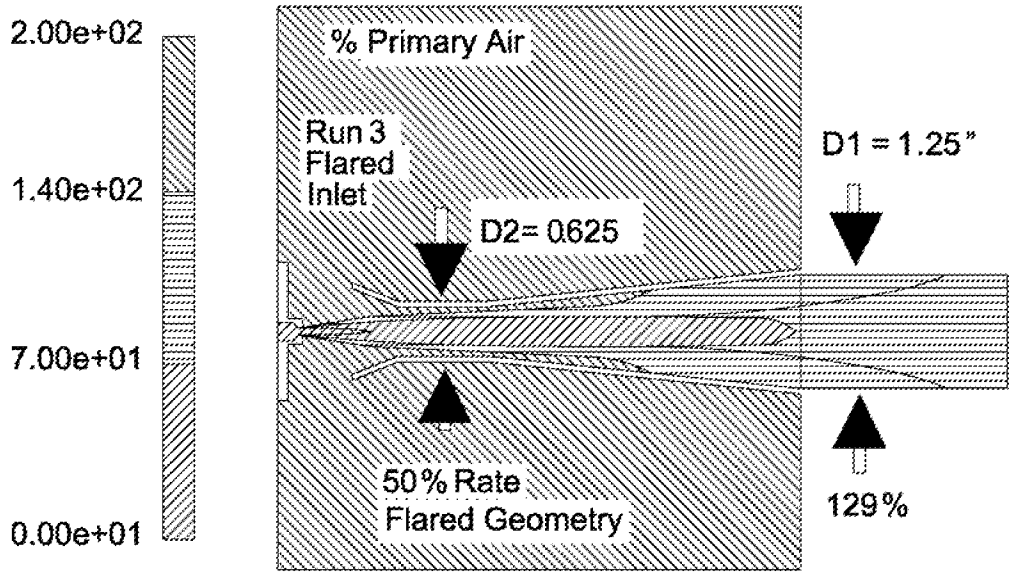
FIG. 7 is a table illustrating design parameters for a venturi assembly according to an embodiment of the present disclosure.

FIG. 6 illustrates a cross-sectional view of the venturi assembly 210 including the injet assembly 212 and a portion of the cooktop 14, while FIG. 7 is a table illustrating design parameters for one embodiment of a venturi assembly 210 incorporating aspects of the present disclosure. In this example, the venturi assembly 210 is shaped so that the air-to-gas ratio is maintained in a range that extends from approximately 9% to 14%, or preferably 9.4% (100% primary air) to 13.4% (142% primary air). The ratio of the diameter D2 of the inlet portion 506 to the diameter D1 of the venturi elbow transition 512 is generally kept small to maintain the primary air percentage at approximately 100% and to avoid too much air being drawn into the venturi assembly 210 and the inlet 506. As is illustrated by the table in FIG. 7, when D1 is 1.5 inches and D2 is 0.5 inches, the percentage of primary air is approximately 101%.

Figure 9:
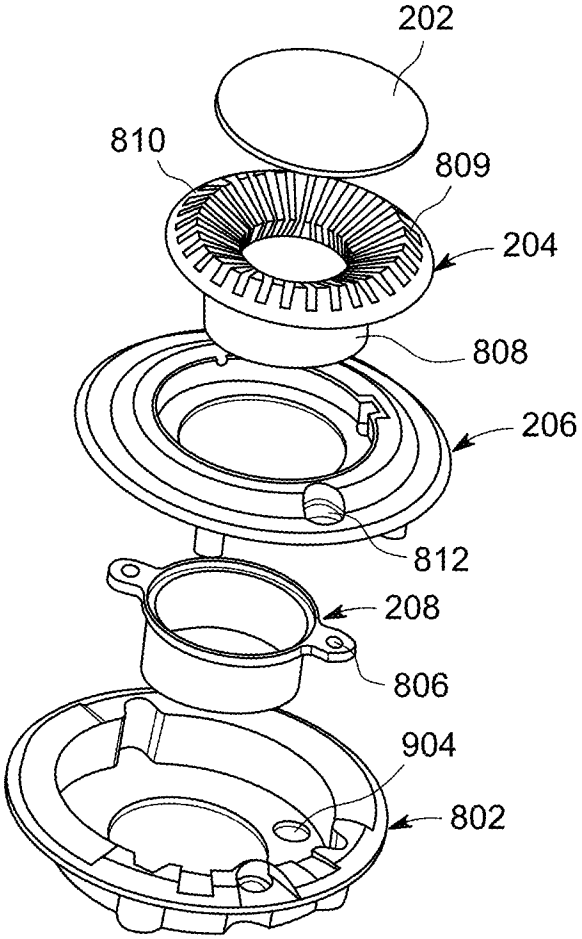
FIG. 9 illustrates a perspective view of the component assembly of the gas burner assembly of FIG. 8 according to an embodiment of the present disclosure.
Figure 8:
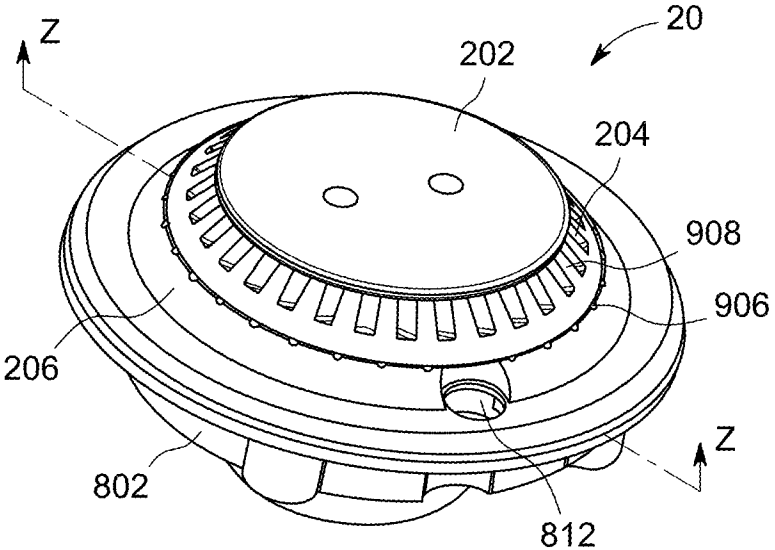
FIG. 8 illustrates a perspective view of a gas burner assembly according to an embodiment of the present disclosure.

Referring to FIGS. 8 and 9, another example of a burner assembly 20 incorporating aspects of the disclosed embodiments is shown. As shown in FIG. 9, in this embodiment, the burner assembly 20 generally comprises cap 202, main burner 204, simmer burner 206, venturi transition assembly or member 208 and a burner base 802. The burner base 802 is generally fastened directly to a surface 804 of the cooktop 14, as shown in FIG. 6. In this example, the venturi transition assembly 208 comprises a ceramic member that provides an interface between the underside of the burner assembly 20 and the venturi assembly 210. The venturi transition member 208 is fastened to the burner base 802 in a suitable manner, such as for example using fasteners in receivers 806. In one embodiment, the simmer ring or burner 206 is configured to be placed or drop into or onto the burner base 802 and does not have to be fastened. Generally, the simmer ring or burner 206 is configured to be easily removable from the burner assembly 20 for cleaning The main burner or ring 204 is generally configured to be placed or drop into the simmer ring 206 without the need for additional fasteners. The lower end 808 of the main burner ring 204 is configured to fit into the venturi transition member 208. In one embodiment, the main burner ring 204 is also not fastened in place and is configured for easy removal.

The burner cap 202 is configured to be placed onto the main burner ring 204 and closes off the main burner combustion chamber 810. An igniter can be placed on a side position 812 outside the burner ports.

Figure 10:
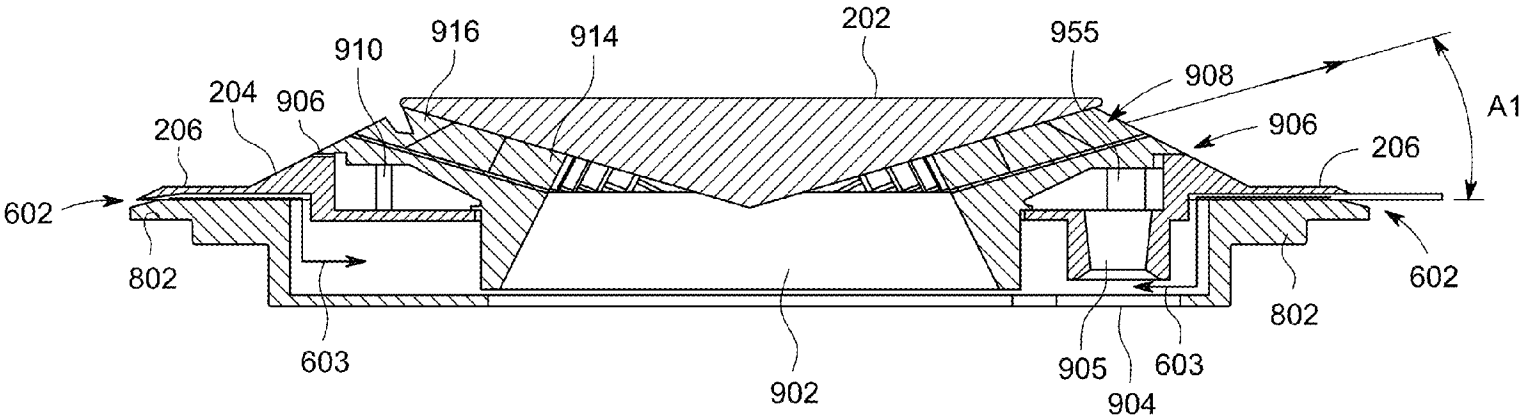
FIG. 10 is a partial cross-sectional view of the burner assembly of FIG. 8 taken along the line Z-Z.

Referring to FIGS. 6 and 10, the simmer burner ring 206 is generally configured to pull or draw its air from the top side 804 of the cooking surface 14 into the region or inlet 602 between the burner base 802 and the simmer burner ring 206. This air enters inlet 602 and travels along path 603 until it is entrained into the gas flow as it comes out of the simmer orifice or gas inlet 904 and enters the integrated simmer venturi 905 on the simmer ring 206. The aspects of the disclosed embodiments generally pull all air for the simmer burner 206 from above the cooktop surface 804.

Figure 11:
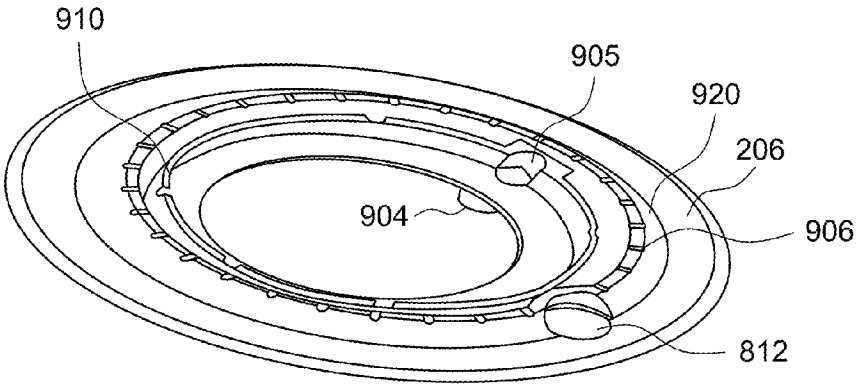
FIG. 11 is a perspective view of a simmer burner ring according to an embodiment of the present disclosure.
Figure 12:
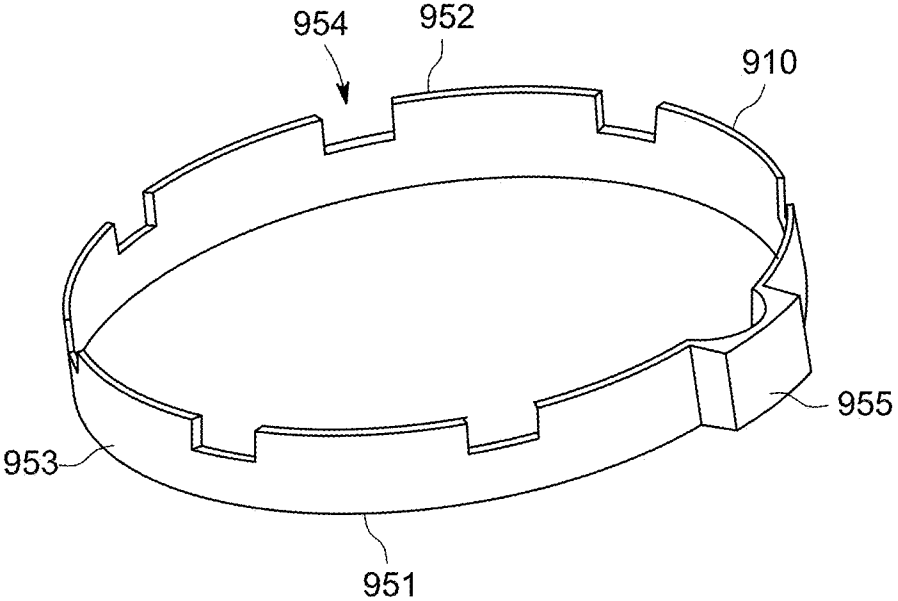
FIG. 12 is a perspective view of a flow dam according to an embodiment of the present disclosure.

Referring to FIGS. 10-12, because the burner assembly 20 is compact, and the inlet 902 to the main burner 204 is fairly large, the inlet 904 into the simmer burner ring 206 is generally asymmetric. This can result in an asymmetric flow distribution out of the simmer flame ports 906. To avoid this situation and allow for a more even, symmetrical flow, in one embodiment, a flow dam 910 is added to the simmer burner 206 as shown in FIG. 11. The flow dam 910 generally comprises a pressure dam that is configured to redistribute gas flow within the simmer burner ring 206. The flow dam 910 is generally configured to be placed into the simmer burner 206 without the need for fastening devices.

FIG. 12 illustrates one embodiment of a flow dam 910. In one embodiment, the flow dam 910 is generally a thin wall member sitting in the middle of the simmer mixing chamber. As is shown in FIG. 12, the flow dam 910 is substantially cylindrical shaped, having a bottom edge 951, a top edge 952 and a wall member 953 therebetween. The bottom edge 951 is generally configured to be substantially flat and sit within or on the simmer burner 206. The top edge 952 is in near contact with the main burner 204 above it. In one embodiment, the top edge includes one or more notches or ports 954. As is shown in FIG. 12, the ports 954 are distributed around the top edge 952 to force the gas mixture within the simmer burner 206 to move more evenly outward, prior to exiting the simmer exhaust ports 906. In one embodiment, the flow dam 910 is incorporated within the simmer burner ring 206 at the location where the flow out of the venture assembly 210 is directed inwardly first towards a center region of the simmer burner 206, and then allowed to redistribute outwardly through the ports 954, after which it eventually enters the flame exit ports 906 for the simmer burner 206. The flow dam 910 includes a protruding member 955 to provide an opening for top of the simmer venture 905.

In one embodiment, the distribution of the notches 954 along the top edge 952 of the flow dam 910 is such that there are more notches 954 along the top edge 952 at positions farther away from the gas inlet 904, as is shown in FIG. 11. Having fewer notches 954 closer to the gas inlet 904 provides more pressure resistance at points closer to the gas inlet 904 than farther away from the inlet 904. Without the flow dam 910, the gas mixture would have a tendency to predominantly exit the simmer burner 206 out of the gas ports 906 that are closest to the gas inlet 904. Increasing the pressure resistance forces the gas mixture to move more evenly outward, along the circumference of the simmer burner 206, as the gas mixture will seek the least resistive path to exit into the gas ports 906.

In one embodiment, the flow dam 910 is a separately fabricated aluminum part. In alternate embodiments, the flow dam 910 is cast or machined as an integral part of the simmer burner 206.

Figure 13:
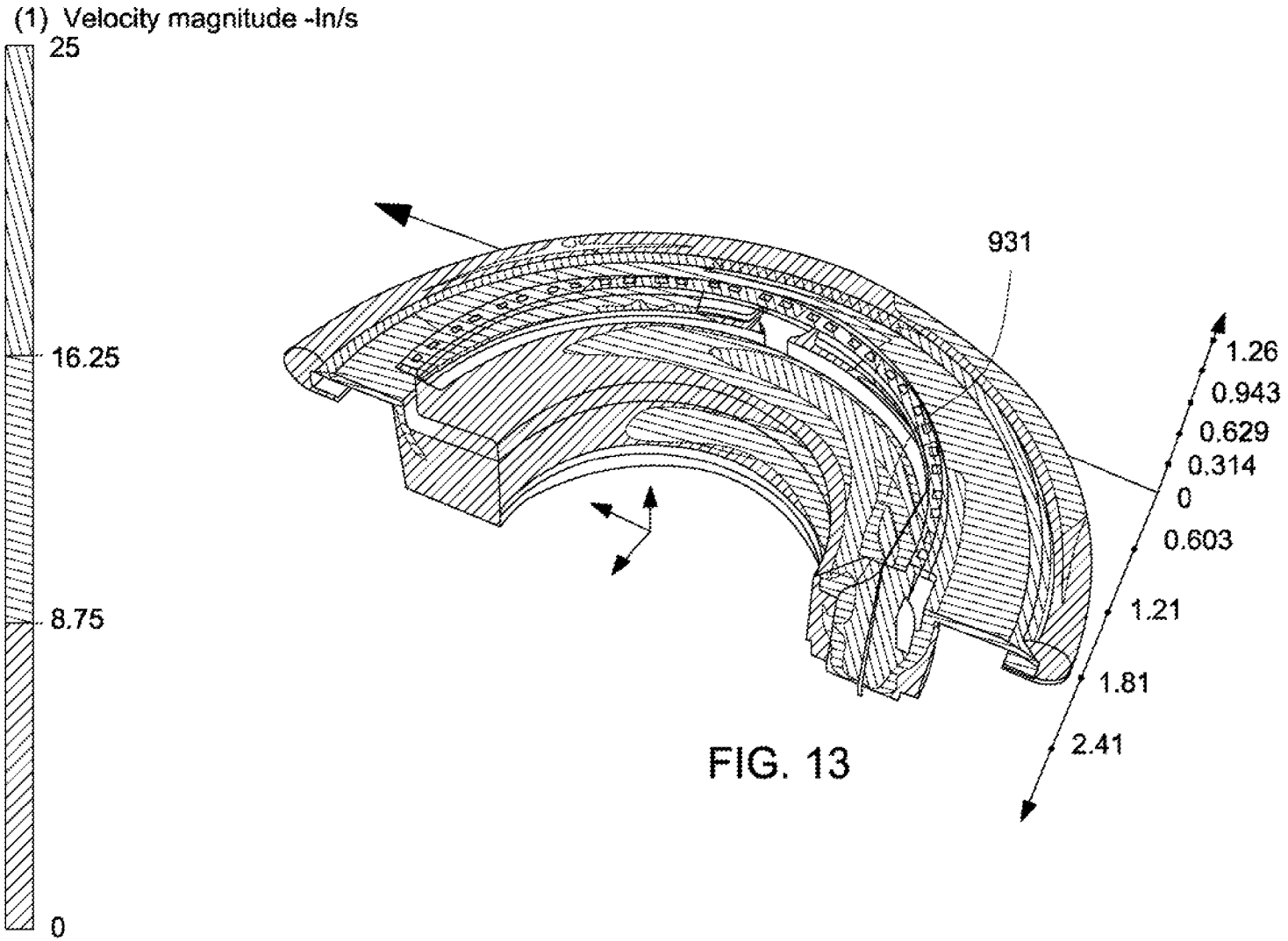
FIGS. 13 and 14 are perspective views of a portion of the simmer burner ring of FIG. 11 showing flame flow according to an embodiment of the present disclosure.
Figure 14:
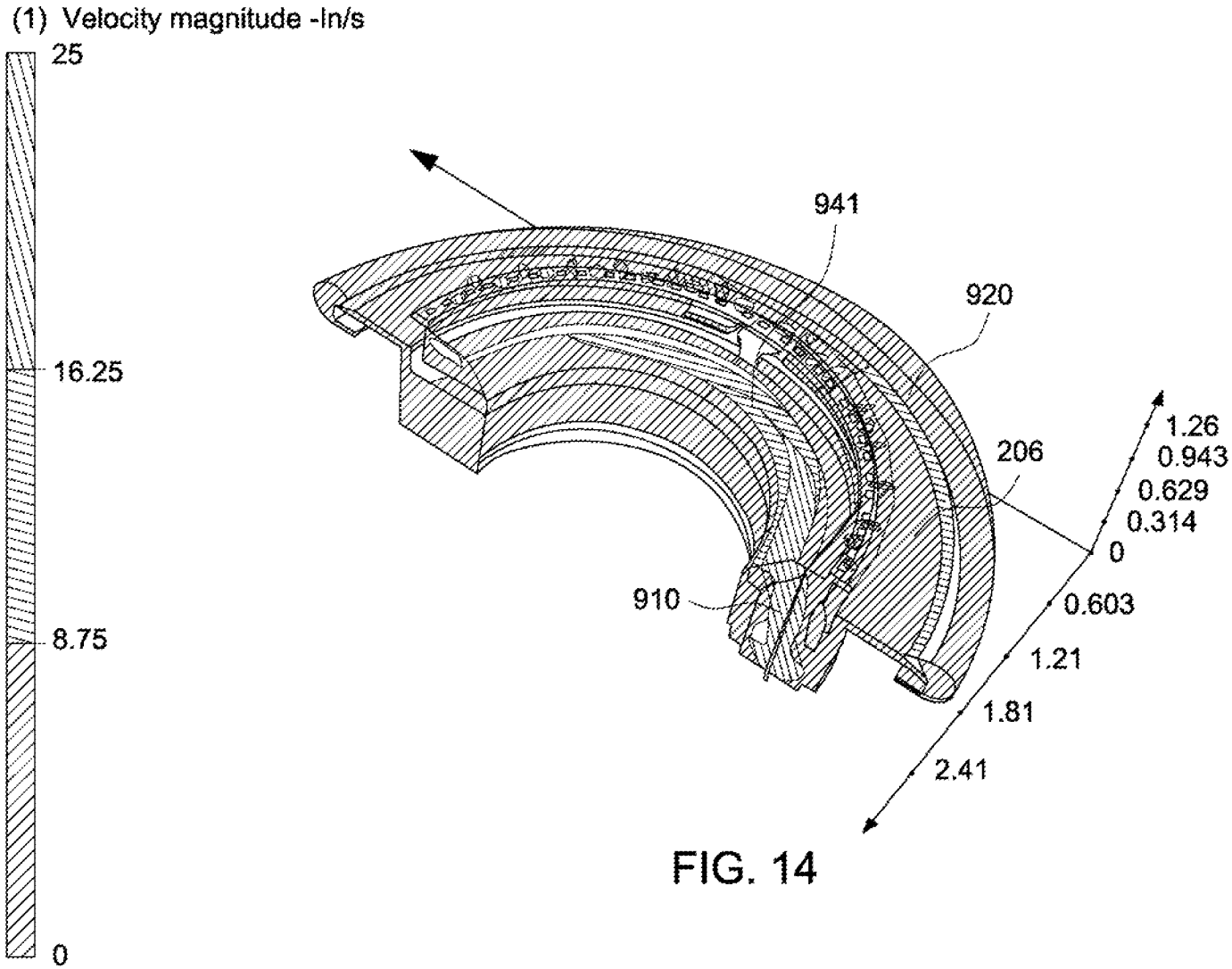

FIGS. 13 and 14 illustrate flame flow comparisons of a simmer burner ring 206 without and with the flow dam 910. In FIG. 13, the simmer ring 206 does not include a flow dam 910, while in FIG. 14, the flow dam 910 is incorporated into the simmer ring 206. The flame flow velocity is shown as 931 in FIG. 13 and 941 in The incorporation of the flow dam 910 as shown in FIG. 14 provides a more even distribution of flow velocities 941 coming out of the simmer ports 906 along the top 920 of the simmer burner ring 206. Instead of seeing flow velocities 931 ranging from 5 to 26 in/sec as in a conventional simmer ring without a flow dam 910 as is shown in FIG. 13, the simmer ring 206 forces a tighter velocity distribution of approximately 20 to 25 in/sec. This tight velocity distribution at the simmer ports 906 allows the gas flow to be turned down without flashback (combustion back into the burner mixing zone) due to low gas velocities. For natural gas, the velocity must be maintained at least 1 in/sec to stay faster than the flame velocity, which is a physical/chemical characteristic, not a design characteristic.

While a pressurized, fully aerated burner is not necessarily more efficient than a standard burner, it does provide opportunities to improve efficiency. In one embodiment, referring to FIGS. 9 and 15, the interface angle that directs the gas flow through the transition member 809 between the burner cap 202 and the main burner 204 can be increased. On a conventional burner, the gas exits the flame exit ports in a direction that is substantially parallel relative to the plane of the cooking surface and the bottom of the cooking utensil. This parallel orientation is optimal for drawing in large amounts of secondary air, since it ensures that the cooking utensils are not brought in close proximity to the flame. Secondary air intake is necessary for complete combustion in conventional burners that have low amounts of primary air, as incomplete combustion can result in the generation of gaseous carbon monoxide and the production of solid carbon soot, which can then condense or deposit on the rangetop or the utensils.

In one embodiment, referring to FIG. 10, the transition member 809 is configured so that the flame exits the flame exit ports 908 at an angle A1 relative to the plane of the cooking surface 14. In one embodiment, the angle A1 is in the range of approximately 30 to 70 degrees vertically, relative to the plane of the cooking surface 14. It is expected that this orientation of the flame can improve boil times by almost 40% compared to flames that are exiting the main flame ports of a conventional burner substantially parallel to the cooking surface 14. In this embodiment, angle A1 does not interfere with combustion, as combustion is achieved mostly with primary air, which is not affected by the placement of a utensil as a typical burner would be.

Figure 16:
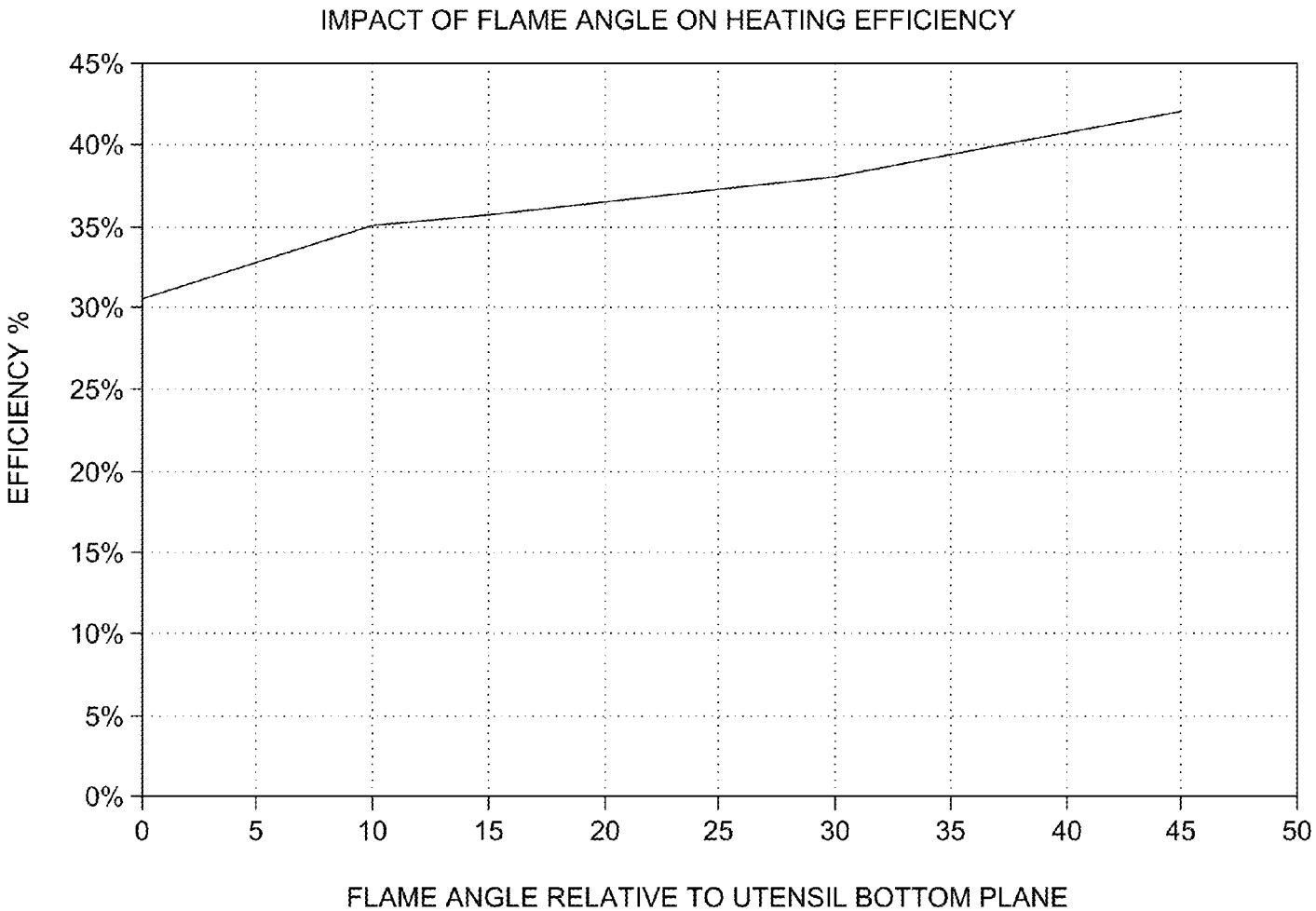
FIG. 16 is a graph illustrating flame angle impact on heating efficiency according to an embodiment of the present disclosure.

FIG. 16 shows an empirical correlation of the efficiency of a burner assembly 20 incorporating aspects of the disclosed embodiments based on standard boiling tests. As can be seen from the graph in FIG. 16, the heating efficiency generally increases as the flame angle A1 of FIG. 10 increases, relative to the utensil bottom plane.

Figure 15:
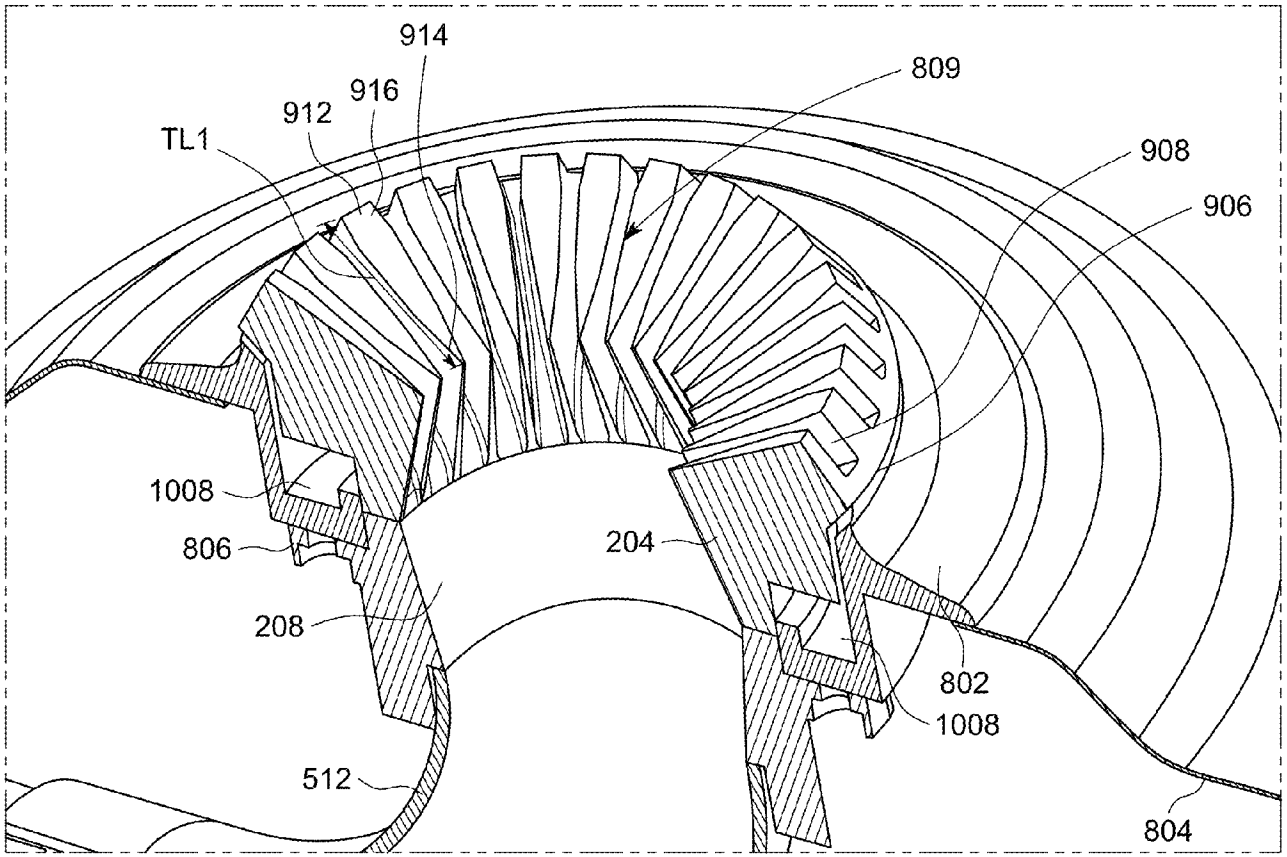
FIG. 15 is a perspective, partial, cross-sectional view of the burner assembly of FIG. 6 without the cap in place according to an embodiment of the present disclosure.

In a typical main burner ring, the transition regions between the pre-combustion chamber and the flame exit ports are typically fairly thin and not tapered. This type of a structure will generally create regions of high turbulence intensity at the flame ports, which can create a large amount of noise during combustion. In one embodiment, referring to FIG. 15 a length TL1 of each element 912 of the transition member 809 in the main burner body 204 is increased. In one embodiment, the length TL1 of each element 912 is in the range of approximately 0.5 to 1.25 inches, and preferably approximately 0.75 inches. As shown in this example, both the inlet end 914 and the outlet end 916 of the transition member elements 912 are tapered. As is shown in FIG. 15, the outlet end 916 of the transition member 912 has a larger cross-sectional area that the inlet end 914. The tapering at the outlet end provides a smoother airflow entry than an otherwise straight flame port 908. Upstream obstructions and pressure losses adversely affect air entrainment into the venturi. By smoothing out the gas/air flow entry into the port 908 the pressure losses through the burner are reduced, which enables better primary air entrainment into the venturi. In one embodiment, the corners can be curved or rounded to further reduce losses. The taper at the inlet end 914 promotes better mixing of gas and air prior to exiting the burner. If proper mixing of air and gas does not occur before exiting the flame port 908, combustion occurs outside of the burner, which is very loud. The inlet end 914 taper expands the flow path of air and gas through the port 908 which promotes better mixing, thus providing for a smoother, more uniform combustion across the flame port 908.

Figure 17:
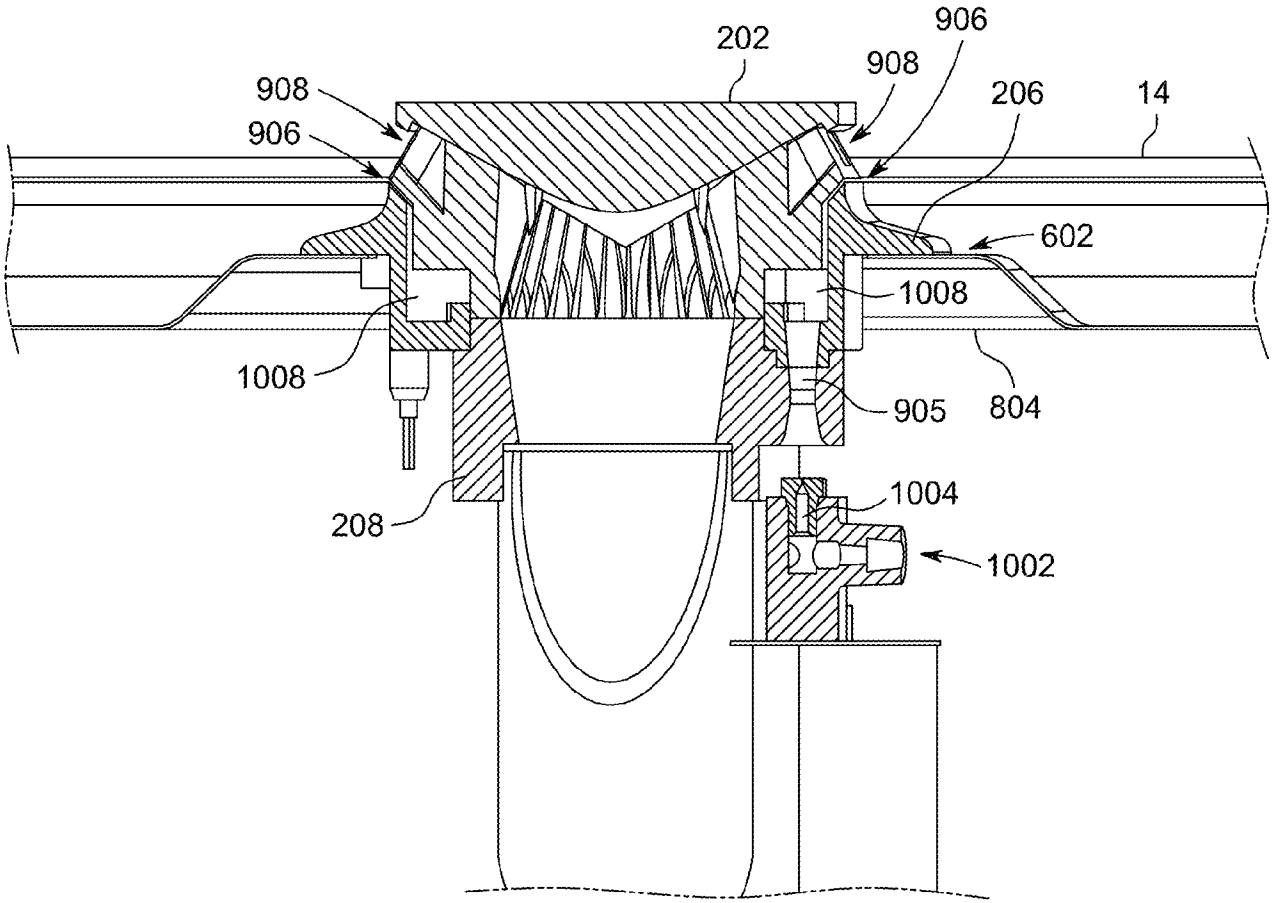
FIG. 17 is a partial cross-sectional view of the burner assembly shown in FIG. 2 taken along the line Y-Y.
Figure 18:
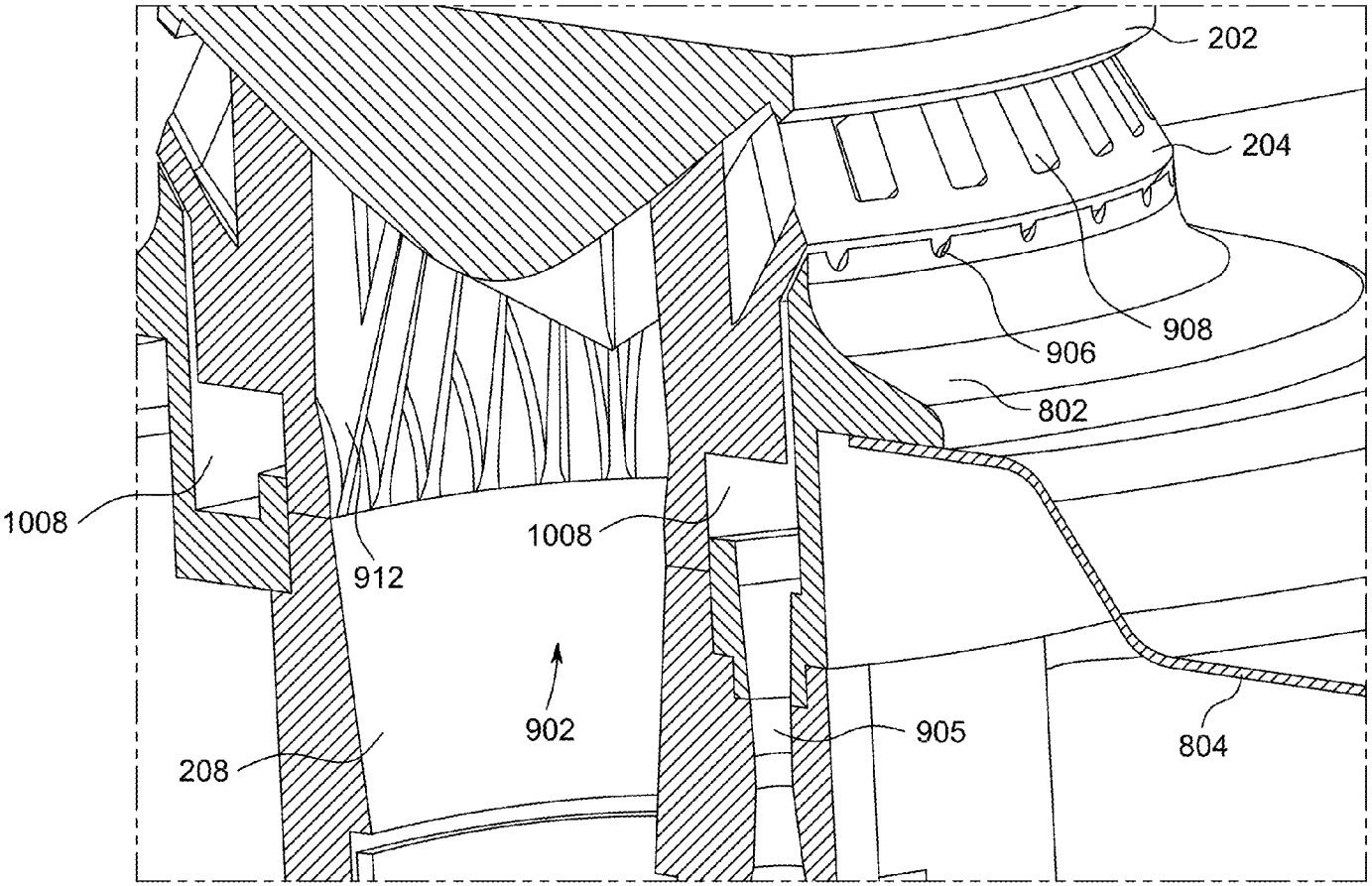
FIG. 18 is a close-up view of the partial cross-sectional view shown in FIG. 15.

FIG. 17 illustrates a cross-section of the turbo burner assembly 200 and venturi assembly 210 of FIG. 2, taken along the line Y-Y, emphasizing the simmer feed into the simmer burner 206. As is shown in FIG. 17, a gas supply inlet 1002 allows a flow of gas provided to the simmer burner 206, generally via the simmer tubing 220 shown in FIG. 1. The gas supply is received in the simmer gas orifice 1004 and supplied to the simmer venturi 905. In one embodiment, the venturi 905 is integral to the venturi transition assembly 208. The "gas" is supplied to the outer simmer chamber 1008. FIG. 18 is a close-up view of a portion of FIG. 17, illustrating the simmer venturi 905 and simmer chamber 1008.

Figure 19:
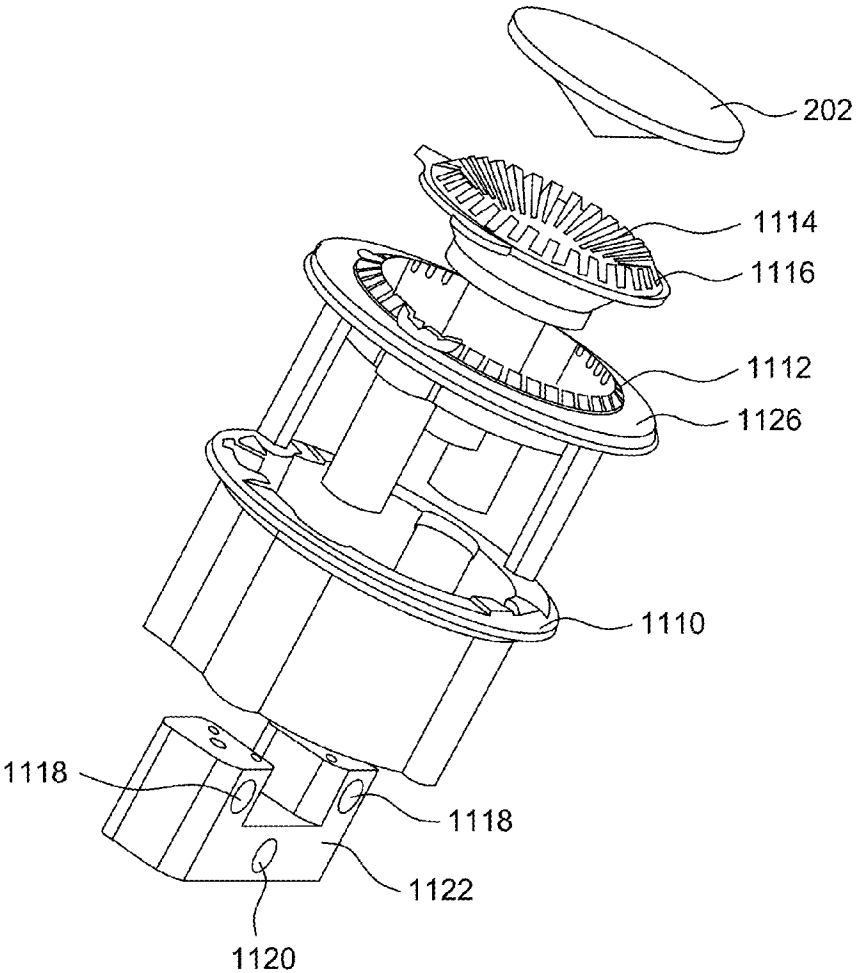
FIGS. 19-22 are views of a burner assembly according to an embodiment of the present disclosure.
Figure 21:
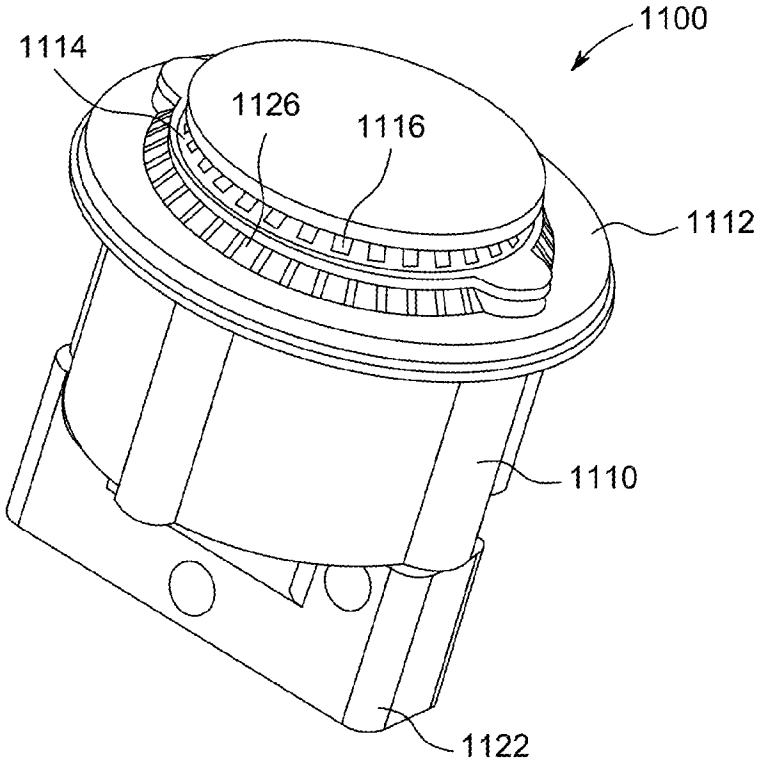
Figure 20:
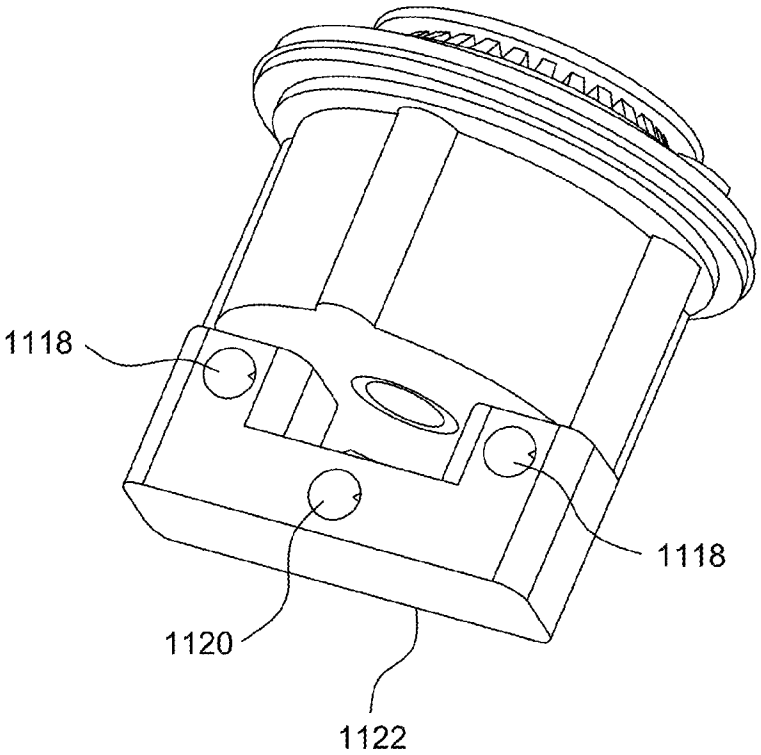
Figure 22:
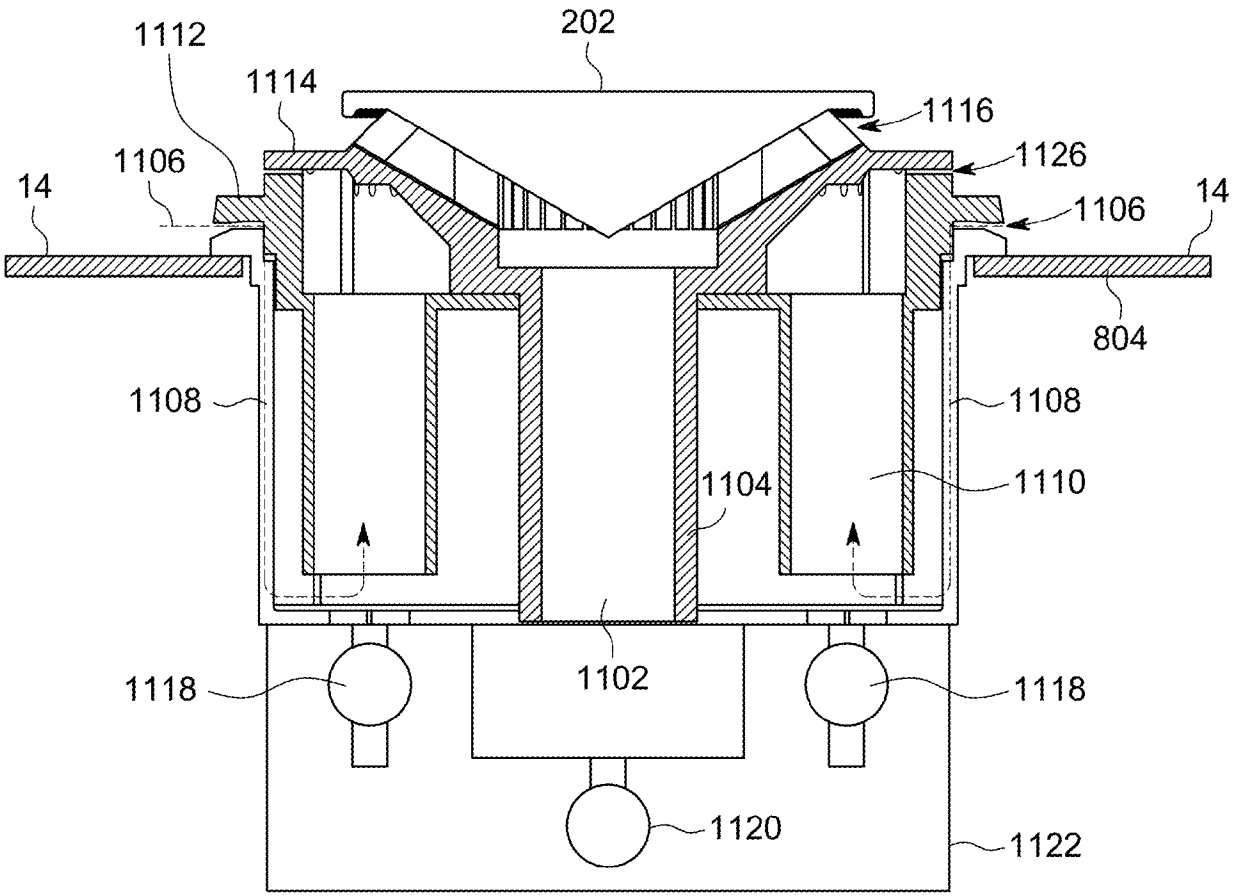

FIGS. 19-21 illustrate an alternative embodiment of a burner and venturi assembly 1100. In this example, instead of an elbow transition section, such as section 512 shown in FIG. 5, the primary air intake 1102 into main burner 1114 comprises a short and straight venturi section 1104, as is shown in FIG. 22. Gas for each of the simmer and main burners 1112, 1114 is provided through the dual injet 1122. As shown in FIG. 19, for example, the dual injet 1122 includes gas inlets 1118, 1120 for each of the simmer and main burners 1112, 1114, respectively. In this example, two simmer gas inlets 1118 are provided, while there is only one main gas inlet 1120.

The air for the simmer burner 1112 is entrained through the intake 1106 and into the mixing chamber 1110. The simmer flames exit the simmer burner ports 1126 for simmer burner 1112. As shown in FIG. 22, the air is entrained from underneath the main burner section 1114 but from above the top surface 804 of the cooktop 14. The air travels along the path 1108 under the simmer burner section 1112 and into the mixing chamber 1110. In this embodiment, the venturi 1104 can be approximately two inches in length with smaller main burner ports 1116. The main burner ports 1116 need to be smaller in order to throttle back the primary air intake 1102 into the main venturi 1104 to avoid lean conditions when the flame cannot be maintained.

The aspects of the disclosed embodiments generally improve pre-combustion gas-air mixing in a multiple gas burner cooking appliance. To increase the output range of the appliance, two combustion stages are provided. The first stage covers the lower range of operation, including a simmer operation. The second stage supplements the bulk of the output and is supplied with 100% or more of the pre-combustion gas-air mixture to ensure full combustion at the burner ports. A gas pump is provided to pressurize the gas supply so that high gas velocities at desired volumetric flow rates can be achieved.

The gas burner assembly of the disclosed embodiments also reduces noise typically generated in high turbulent intensity zones near the flame ports when high flow rates are being distributed to the main burner. By increasing a length of the transition zones in the main burner output and tapering the inlet and outlet ends, the white noise generated can be significantly reduced.

The aspects of the disclosed embodiments also improve the efficiency of the burner to deliver heat to the cooking utensils. By altering the angle at which the burner ports deliver the output flow to the cooking utensil, the efficiency and heat delivery is increased.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas burner assembly for a cooking appliance comprising:

a main burner assembly;

a simmer burner assembly positioned in a stacked relationship with and located below the main burner assembly;

a venturi assembly for delivering a gas flow to the main burner assembly;

a gas valve assembly for controlling a rate of the gas flow;

a gas boost pump configured to control a pressurization of the gas flow between the gas valve assembly and the main burner assembly; and an encoder coupled to the gas valve assembly, the encoder configured to track a position of the gas valve assembly and provide a signal to the gas boost pump for pressurization of the gas flow; and wherein the simmer burner assembly comprises a simmer burner venturi, simmer flame exit ports, and a flow dam communicatively received within the simmer burner assembly between the simmer burner venturi and the simmer flame exit ports, the flow dam comprising one or more ports along an upper edge of the flow dam, the one or more ports being positioned closer together along the upper edge of the flow dam in a region opposite the simmer burner venturi than in a region adjacent to the simmer burner venturi.

2. The gas burner assembly of claim 1, further comprising a burner high output control configured to increase an output of the main burner to a maximum level, the burner high output control being enabled for activation when a position of the encoder is in a burner high output range.

3. The burner assembly of claim 2, wherein the burner high output control comprises a switch.

4. The burner assembly of claim 2, wherein the burner high output range is from approximately 10,000 Btu/hr to 25,000 Btu/hr.

5. The burner assembly of claim 1, further comprising:

a simmer stage gas flow path configure to supply the gas flow to the simmer burner assembly; and a main stage gas flow path configured to supply the gas flow to the gas pump, wherein the gas valve assembly is configured to direct the gas flow to the simmer stage gas flow path or the main stage gas flow path depending upon the position of the gas valve assembly.

6. The burner assembly of claim 5 wherein the simmer stage gas flow path supplies a gas flow rate of approximately 0.5 to 4.0 KBtu/hr.

7. The burner assembly of claim 1, wherein the venturi assembly comprises a gas flow inlet portion having a first diameter and a gas flow main portion coupled to the main burner assembly, the gas flow main portion having a second diameter, and wherein a ratio of the second diameter to the first diameter is approximately 2:1.

8. The burner assembly of claim 7, wherein the gas flow main portion of the venturi assembly includes an approximately 90-degree bend portion.

9. The burner assembly of claim 1, further comprising a burner base coupled to a surface of a cooktop, the simmer burner assembly being communicatively received in the burner base, the simmer burner assembly comprising simmer air inlet ports for drawing air into the gas flow, the simmer air inlet ports being positioned to draw the air from a region between the surface of the cooktop and the burner base.

10. The burner assembly of claim 1, wherein the flow dam is configured to redistribute a gas flow mixture from the simmer burner venturi to the simmer flame exit ports in a substantially symmetrical manner.

11. The burner assembly of claim 10, wherein the flow dam further comprises a protruding member providing an opening for a top of the simmer burner venturi, the one or more ports being distributed along the upper edge of the flow dam away from the protruding member.

12. The burner assembly of claim 1, wherein the main burner assembly comprises:

a pre-combustion chamber;

a flame exit port; and a transition region between the pre-combustion chamber and the flame exit port, the transition region being tapered at both ends of the transition region.

13. The burner assembly of claim 12, wherein an angle of the transition region relative to a cooking surface of the cooking appliance is in a range of 30 to 70 degrees.

14. The burner assembly of clam 12, wherein the flame exit port projects at an upward angle in a range of 30 to 70 degree relative to a cooking surface of the cooking appliance.

15. A burner assembly for a gas cooking appliance, comprising:

a main burner assembly comprising:

a pre-combustion chamber;

a main flame exit port; and a transition region between the pre-combustion chamber and the main flame exit port, each end of the transition region being tapered;

a simmer burner assembly positioned in a stacked relationship with and located below the main burner assembly, the simmer burner assembly comprising:

a simmer burner combustion chamber;

a simmer flame exit port;

a flow dam ring positioned within the simmer burner combustion chamber, the flow dam ring comprising one or more ports along an upper edge of the flow dam ring, the ports configured to redistribute gas flow within the simmer burner combustion chamber; and a simmer burner venturi for introducing a gas flow into the simmer burner combustion chamber, the flow dam ring including a protruding member providing an opening for a top of the simmer burner venturi, wherein the one or more ports of the flow dam ring are positioned closer together along the upper edge of the flow dam ring in a region opposite the simmer burner venturi than in a region adjacent to the protruding member and simmer burner venturi.

16. The burner assembly of claim 15, wherein the tapered transition region has an angle relative to a plane of a cooking surface of the appliance in the range of approximately 30 to 70 degrees.

17. The burner assembly of claim 15, wherein the tapered transition region has a first end nearest the pre-combustion chamber and a second end at the main flame exit port, and the second end has a cross-sectional area that is greater than the first end.

18. The burner assembly of claim 15, wherein the flow dam ring is positioned vertically between a bottom of the main burner transition region and a floor of the simmer burner combustion chamber.

19. A gas burner assembly for a cooking appliance comprising:

a main burner assembly;

a simmer burner assembly positioned in a stacked relationship with and located below the main burner assembly;

a venturi assembly for delivering a gas flow to the main burner assembly;

a gas valve assembly for controlling a rate of the gas flow;

a gas boost pump configured to control a pressurization of the gas flow between the gas valve assembly and the main burner assembly; and an encoder coupled to the gas valve assembly, the encoder configured to track a position of the gas valve assembly and provide a signal to the gas boost pump for pressurization of the gas flow; and wherein the simmer burner assembly comprises a simmer burner venturi, simmer flame exit ports, and a flow dam communicatively received within the simmer burner assembly between the simmer burner venturi and the simmer flame exit ports, the flow dam comprising one or more ports along an upper edge of the flow dam, wherein the flow dam is configured to redistribute a gas flow mixture from the simmer burner venturi to the simmer flame exit ports in a substantially symmetrical manner, and wherein the flow dam further comprises a protruding member providing an opening for a top of the simmer burner venturi, the one or more ports being distributed along the upper edge of the flow dam away from the protruding member.

* * * * *